US007175031B2

(12) United States Patent
Matthews

(10) Patent No.: US 7,175,031 B2
(45) Date of Patent: Feb. 13, 2007

(54) MULTIPLE TOOL HOLDER

(76) Inventor: Jason E. Matthews, 2700 Lanier Dr., Madison, IN (US) 47250

( * ) Notice: Subject to any disclaimer, the term of this patent is extended or adjusted under 35 U.S.C. 154(b) by 360 days.

(21) Appl. No.: 10/753,104

(22) Filed: Jan. 7, 2004

(65) Prior Publication Data

US 2005/0145587 A1 Jul. 7, 2005

(51) Int. Cl.
*A47F 7/00* (2006.01)

(52) U.S. Cl. ..... 211/70.6

(58) Field of Classification Search ..... 211/70.6, 211/87.01, 135, 71.01, 72; 206/376, 377, 206/378

See application file for complete search history.

(56) References Cited

U.S. PATENT DOCUMENTS

| | | | | |
|---|---|---|---|---|
| 2,805,777 | A * | 9/1957 | Larson | 211/70.1 |
| 3,187,902 | A | 6/1965 | Nelson | |
| 3,737,131 | A * | 6/1973 | Larson | 248/220.41 |
| 4,467,925 | A | 8/1984 | Ratzloff et al. | |
| 4,867,332 | A | 9/1989 | Mains | |
| 5,303,500 | A | 4/1994 | Luukonen | |
| 5,331,904 | A | 7/1994 | DiSimone et al. | |
| 5,386,915 | A | 2/1995 | Sirhan | |
| 5,615,782 | A | 4/1997 | Choe | |
| 5,678,700 | A * | 10/1997 | Crosson, Jr. | 211/70.8 |
| 5,685,468 | A | 11/1997 | Hernandez et al. | |
| 5,743,416 | A | 4/1998 | Yemini | |
| 5,803,422 | A | 9/1998 | Buehler | |
| 5,806,822 | A * | 9/1998 | Schulz | 248/309.1 |
| 6,041,717 | A | 3/2000 | Kubat | |
| 6,095,057 | A | 8/2000 | Corban | |
| 6,109,435 | A | 8/2000 | Failor | |
| 6,360,891 | B1 | 3/2002 | Rideout | |
| 6,467,744 | B1 | 10/2002 | Calin | |

* cited by examiner

*Primary Examiner*—Sarah Purol
(74) *Attorney, Agent, or Firm*—Frost Brown Todd LLC

(57) ABSTRACT

A tool holder having a support member and first and second shelf portions is disclosed. The first shelf portion includes apertures capable of receiving and holding an impact tool or a cup or similar object. The first shelf portion also has slots capable of receiving and holding one or more tools. The second shelf portion is comprised of a plurality of elongated members that are spaced apart such that there are slot-like gaps between the members. The slot-like gaps are capable of receiving and holding one or more tools. The distal end of the elongated members at each end of the plurality of elongated members comprising the second shelf portion extends upward, allowing the holder to hold a coiled hose, cord, or other coiled object. The holder is made of a single piece of steel without welds.

29 Claims, 6 Drawing Sheets

MULTIPLE TOOL HOLDER

BACKGROUND OF THE INVENTION

The present invention relates generally to tool holders, and is particularly directed to a holder which may be mounted on or near an automobile lift and may hold tools, parts, and the like for use by a mechanic in automotive repair.

The field of automotive repair may require a mechanic to have a number of tools on hand. This may be particularly so when the automobile needs to be raised on a lift. Frequently, mechanics may have their tools lying on the ground. Such a scenario may raise the hazard of tripping over the tools and/or creating back pain from repeated bending over to pick up and set down the tools. In addition, particularly when the automobile being worked on is raised on a lift, the extra movement required by picking tools up from the ground and setting them down on the ground may take unnecessary time. Thus, having the tools mounted in a place where the mechanic may quickly access them may enhance the efficiency of the automotive repair process. Keeping the tools off of the floor may also eliminate the hazard of tripping over the tools and may reduce stress on the back by eliminating the need to bend over for tools.

The art includes some tool-holding devices that may be mounted to keep tools off of the ground. However, many existing tool holders have several shortcomings. Many holders, such as the holder disclosed by Buehler in U.S. Pat. No. 5,803,422, and the holder disclosed by Corban in U.S. Pat. No. 6,095,057, are essentially trays where tools and parts may be thrown in an intermingled pile. With such holders, the mechanic may have to dig through a pile to find the desired tool, reducing overall efficiency. In addition, many holders are generally not suitable for holding large tools, such as impact wrenches, or coiled hoses or cords or the like.

Many existing tool holders are also generally rectangular in shape, such that the holders have sharp corners. Such sharp corners may pose eye hazards or other dangers from accidental bumping.

The manufacture of many existing tool holder designs is, as will be demonstrated by the present invention, more complicated and expensive than is necessary for the creation of a suitable tool holder. Many existing tool holders contain multiple welds and/or parts. Such welds and parts increase the time and cost of manufacture by adding assembly steps to the manufacturing process. Not only do multiple welds and parts increase the time and cost of manufacture, but they may also decrease the reliability of the holder, for it is known in the art that welds tend to weaken the metal at or near the site of the weld.

Thus, there exists a need for a tool holder that may be mounted to keep tools and the like conveniently close to the mechanic; may keep tools separated for quick and easy access; may hold impact tools and coiled items; does not have sharp corners; and comprises a single piece without welds.

BRIEF SUMMARY OF THE INVENTION

The present invention provides a holder that may be mounted above the floor and may keep various tools and the like separated for quick and easy access. The present invention also provides a tool holder that does not have sharp corners posing safety hazards, and may be economically manufactured as one piece without the need for welding.

The present invention provides a tool holder comprising a support member having a first shelf portion and second shelf portion extending therefrom. The first shelf portion may have a plurality of slots capable of receiving and holding tools and the like, and at least one generally circular aperture that may receive and hold an impact wrench or other large tool or a tapered cup. A second shelf portion comprises a plurality of spaced apart elongated members that are rounded at their ends, creating slots that may receive tools and the like. The outermost elongated members of the second shelf portion may have their distal ends extend generally upward, such that the second shelf portion may hold a hose, extension cord, or other coiled object. The tool holder may be created from plastic through molding or from metal through a process of cutting and bending or any other suitable material or materials and/or method of creation.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

Reference will now be made in detail to the present preferred embodiment of the invention, an example of which is illustrated in the accompanying drawings.

DETAILED DESCRIPTION OF AN EMBODIMENT OF THE INVENTION

Figure 1:
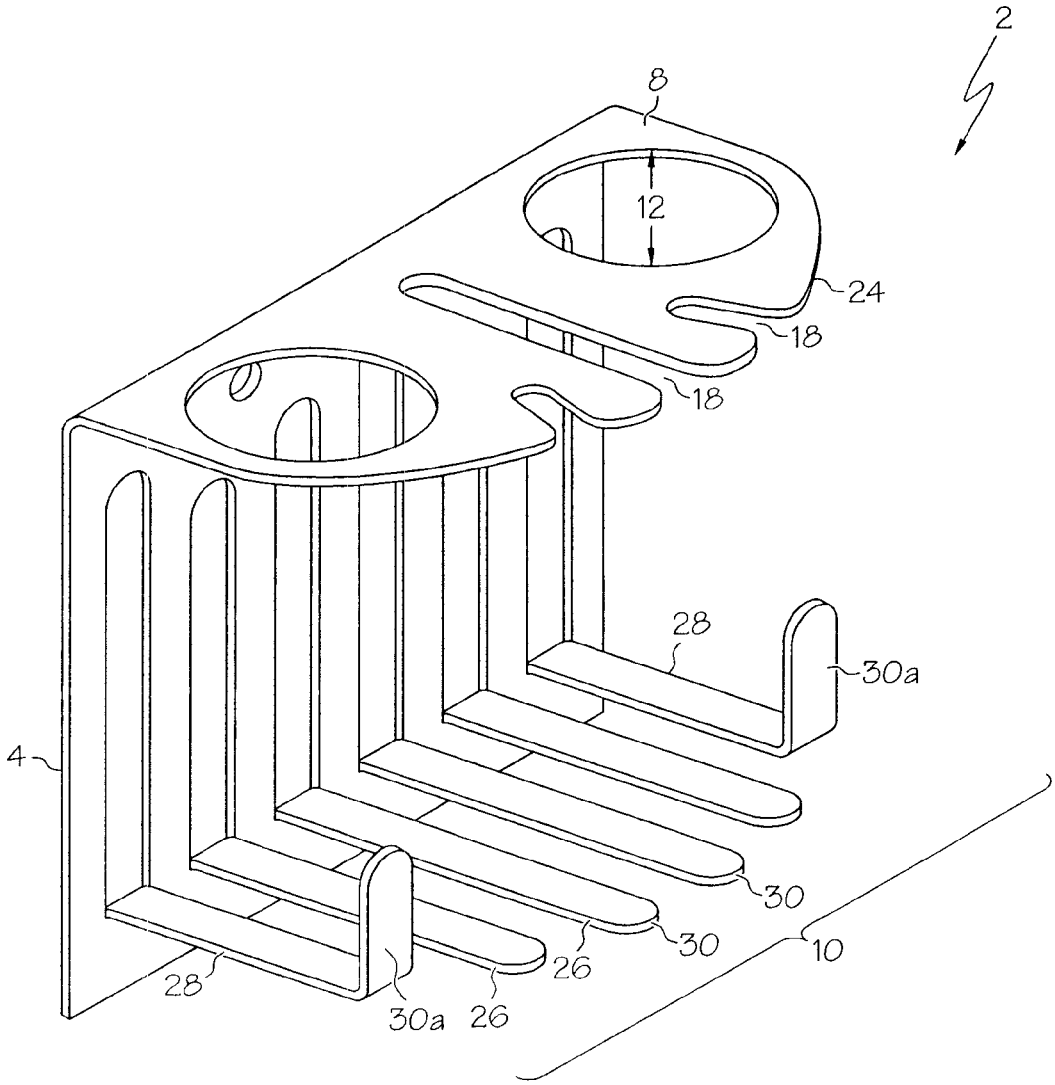
FIG. 1 is a top perspective view of a tool holder constructed in accordance with the present invention.
Figure 2:
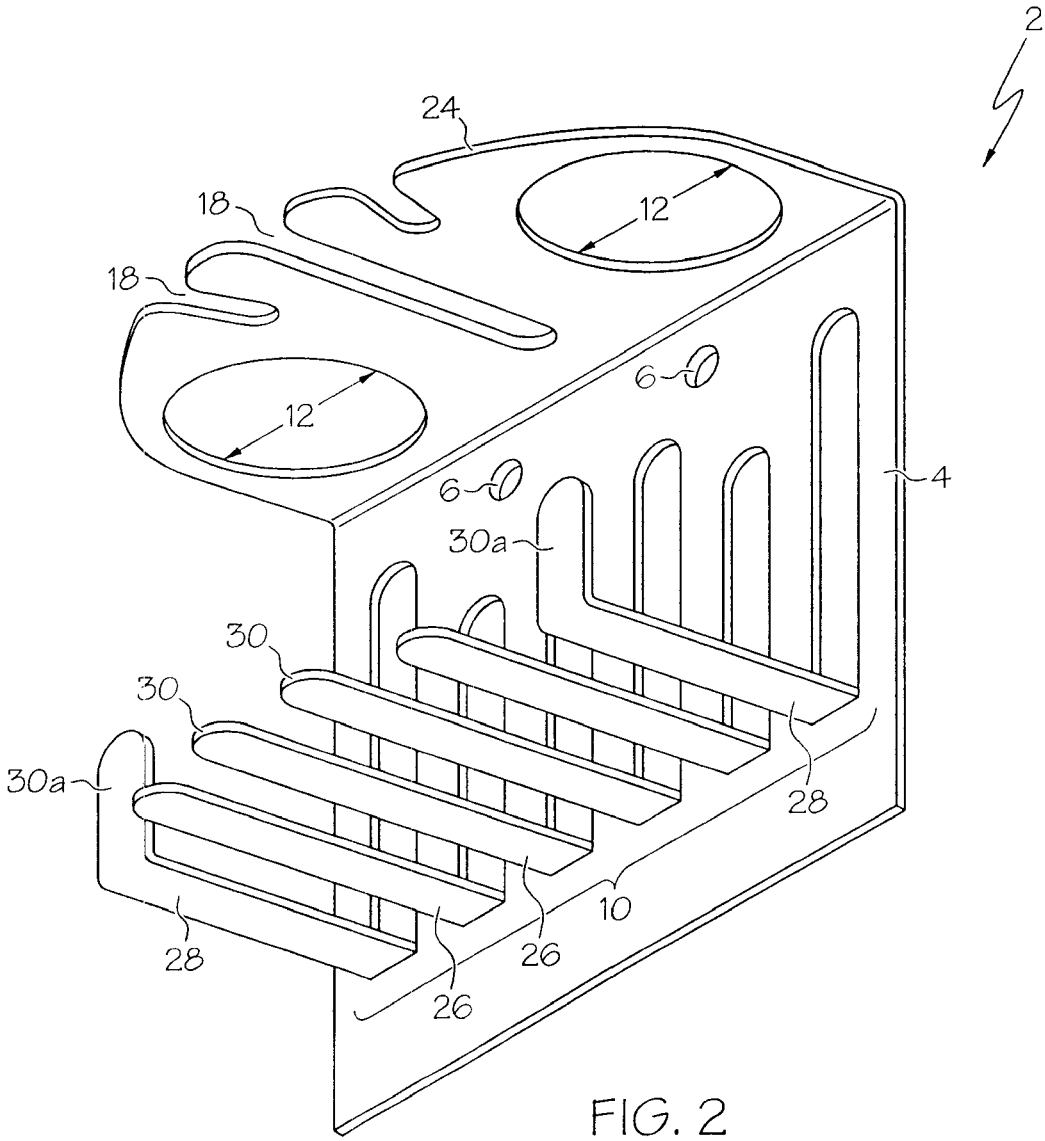
FIG. 2 is a bottom perspective view of the tool holder of FIG. 1.

Referring now to the drawings in detail, wherein like numerals indicate the same elements throughout the views, FIGS. 1 and 2 show tool holder 2 that may be mounted to the column of an automotive lift or any other convenient mounting location. Tool holder 2 includes support member 4, which may act as a back for tool holder 2. As shown in FIG. 2, support member 4 includes one or more mounting holes 6 for mounting tool holder 2 with, for example, bolts or any suitable fastener. Alternatively, tool holder 2 may have no mounting hole or holes 6 and/or may be mounted in any other suitable way. Tool holder 2 may be mounted on the column of an automotive lift. Such a mounting location may maximize efficiency by reducing distance the mechanic has to go to get and/or put tools and the like. However, tool holder 2 may also be mounted on a wall or any other convenient location. If mounted on a lift, tool holder 2 should not be mounted in such a way as to adversely affect the ability of the lift to be raised and lowered.

Tool holder 2 may be manufactured of any suitable material such as, for example, metal or plastic. Tool holder 2 may be manufactured from sheet metal by, for example, a simple process of stamping or cutting, such as by laser cutting, by way of example only, and bending. Alternatively, tool holder 2 may be manufactured by any other suitable method or methods of manufacture. Tool holder 2 may be made of, for example, 10 gauge steel. Of course, the gauge may be varied to accommodate desired tolerances and/or manufacturing costs or other considerations. Tool holder 2 may also be made of a durable, rigid plastic by a process of, for example, injection molding. Alternatively, tool holder 2 may be made from a combination of metal and plastic or any other material or combination of materials.

As shown in FIGS. 1 and 2, tool holder 2 comprises first shelf portion 8 and second shelf portion 10. First shelf portion 8 and second shelf portion 10 extend generally perpendicular to support member 4 and are spaced apart. Alternatively, tool holder 2 may have one or more than two shelf portions.

Figure 3:
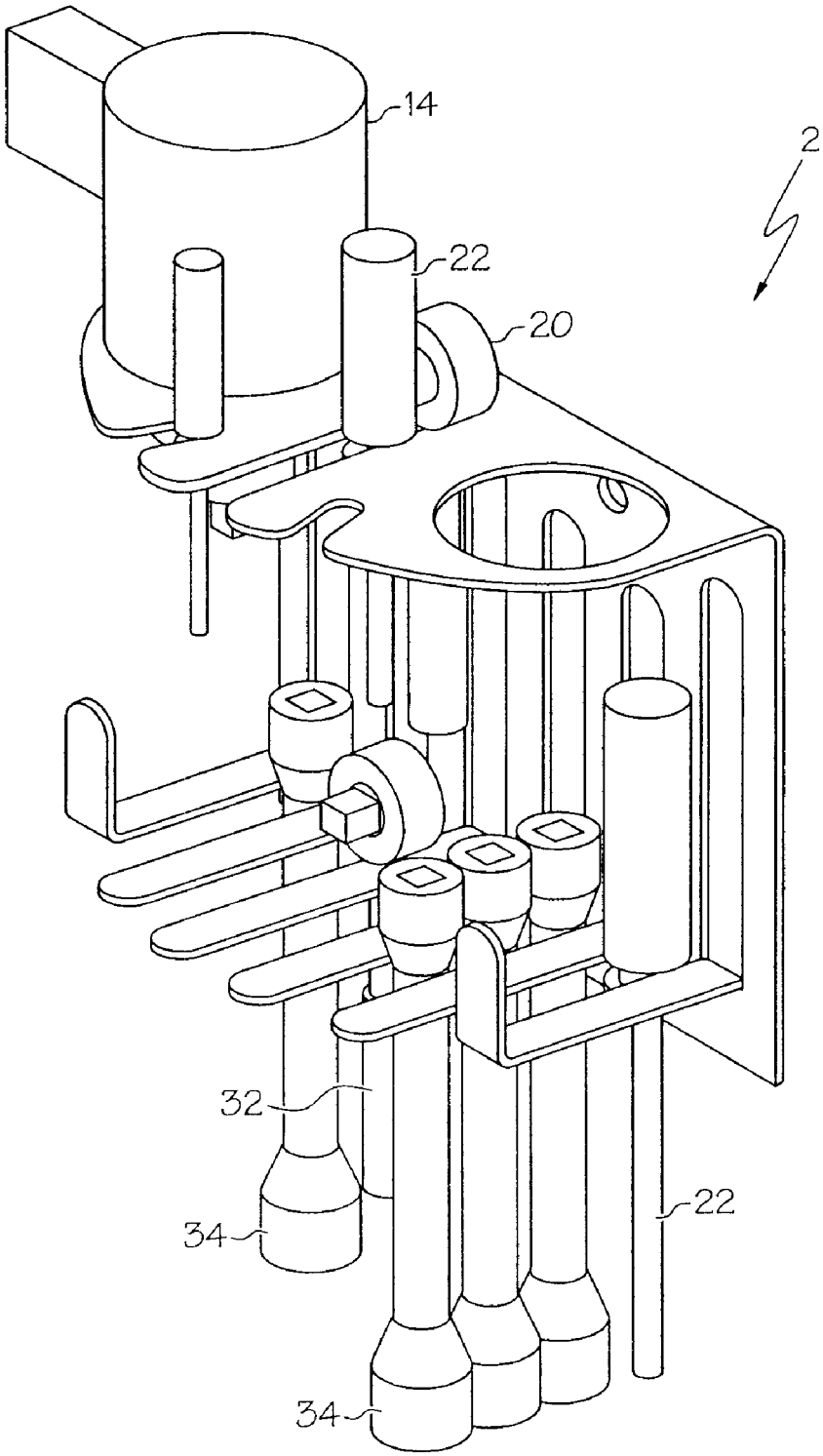
FIG. 3 is a perspective view of the tool holder of FIG. 1 with tools.
Figure 4:
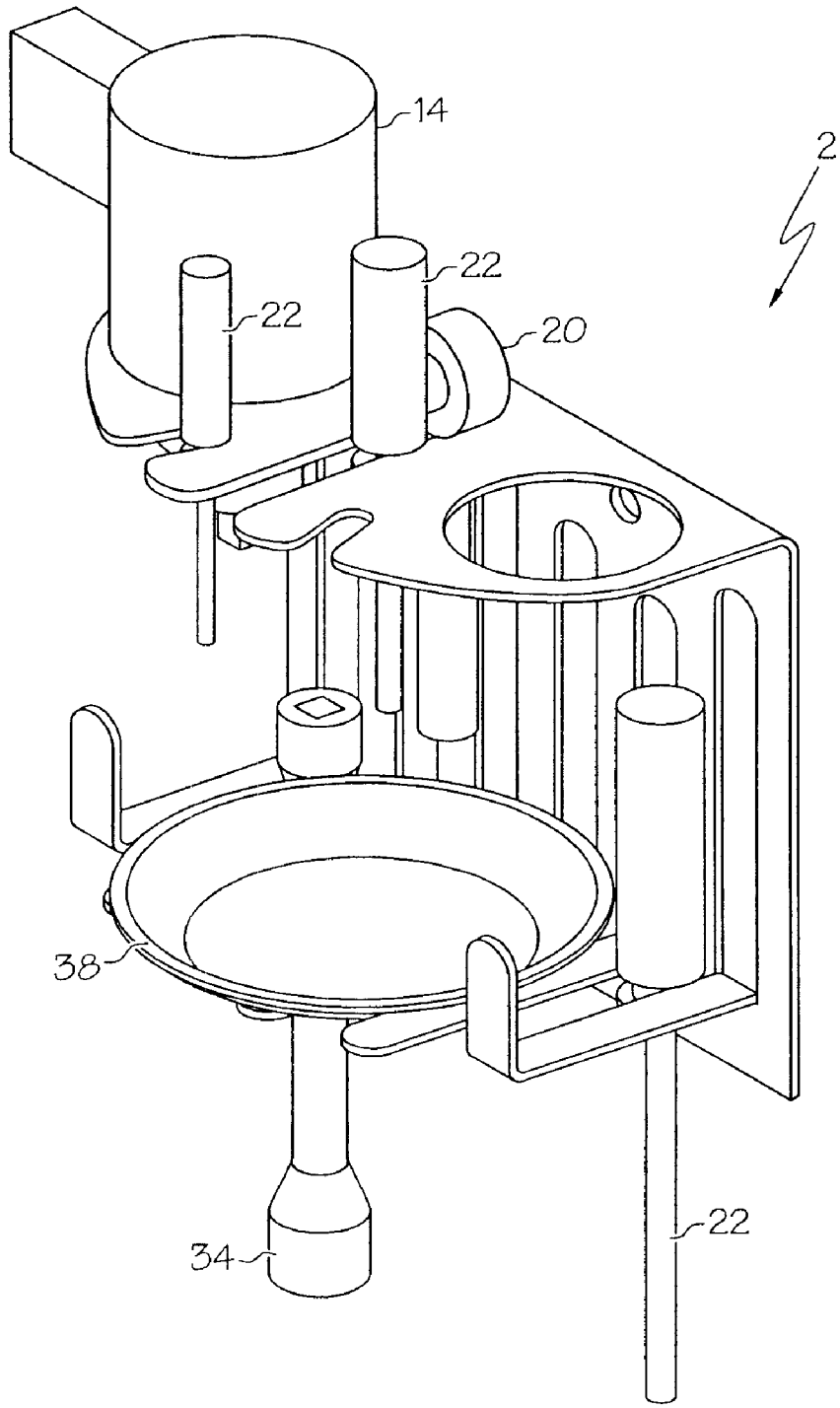
FIG. 4 is a perspective view of the tool holder of FIG. 1 with tools and a magnetic tray.
Figure 5:
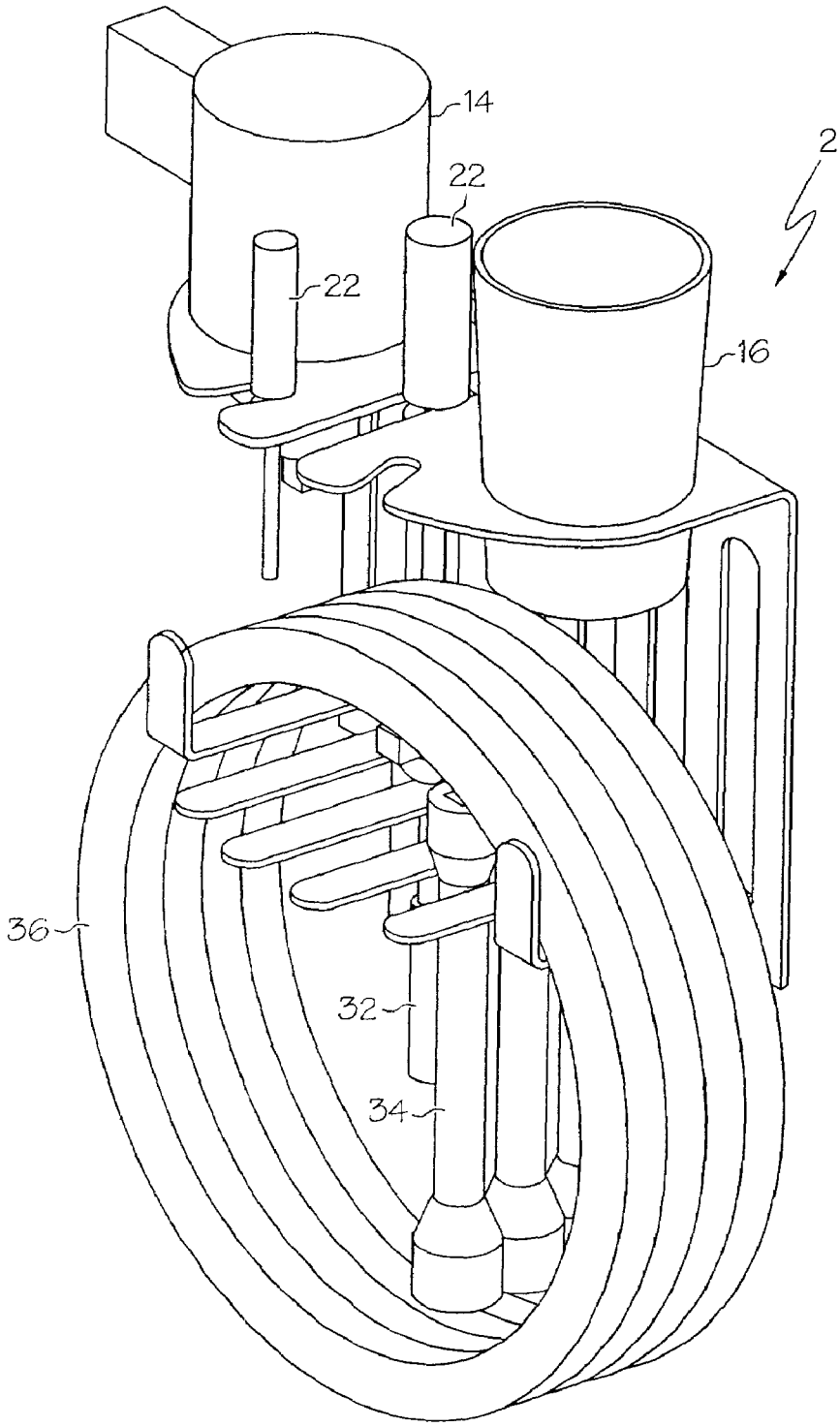
FIG. 5. is a perspective view of the tool holder of FIG. 1 with tools, a hose, and a cup.

First shelf portion 8 has generally circular apertures 12 formed therethrough. Aperture 12 is configured to receive and hold a variety of objects. Aperture 12 may be used to receive and hold impact tool 14, as shown in FIGS. 3, 4, and 5; or cup 16, as shown in FIG. 5; or any other object capable of being received and held by aperture 12. Alternatively, first shelf portion 8 may have any number of apertures 12 formed therethrough, or apertures 12 may be omitted.

First shelf portion 8 includes slots 18 formed therethrough. Slots 18 may be used to receive and hold one or more tools, such as wrench 20 and/or screwdriver 22 as shown in FIGS. 3, 4 and 5; or any other objects capable of being received and held by slots 18. First shelf portion may have any number of slots 18 formed therein, or slots 18 may be omitted. Where slot or slots 18 are used, such slot or slots 18 may be open as shown in FIGS. 1 through 6, or, alternatively, may be closed, such that distal edge 24 of first shelf portion 8 does not follow the interior path of slot or slots 18. Alternatively, first shelf portion 18 may have a combination of open and closed slots 18.

Distal edge 24 of first shelf portion 8 may also be generally arcuate. Such an arcuate configuration may reduce the hazards of sharp corners, such as eye hazards, for example. The arcuate configuration may also contribute to the aesthetic appeal of tool holder 2. Distal edge 24 of first shelf portion 8 may be generally semicircular, parabolic, hyperbolic, or of any other possible desired configuration.

Figure 6:
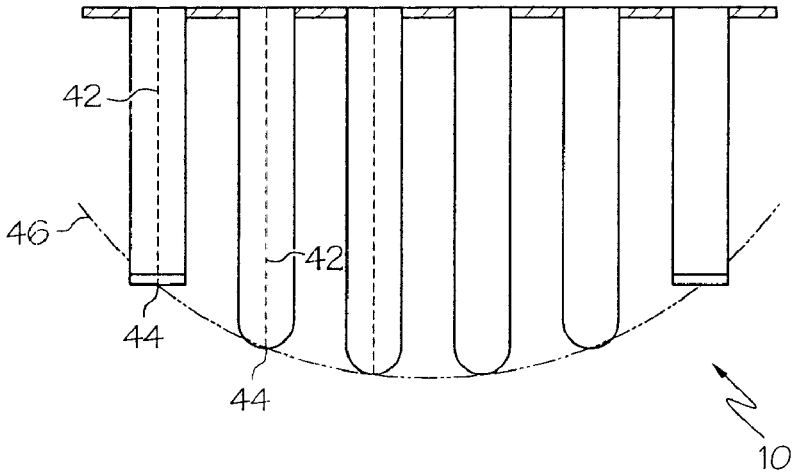
FIG. 6 is a top cross-sectional view of the tool holder of FIG. 1.

As shown, second shelf portion 10 includes a plurality of spaced-apart elongated members 26. By being spaced-apart, elongated members 26 create gaps or slots configured to receive tools or other objects. Each elongated member 26 has generally rounded distal end 30. By making distal ends 30 rounded, hazards of having sharp corners may be greatly reduced. In addition, rounded distal ends 30 may also contribute to the aesthetic appeal of tool holder 2. In part to further reduce safety hazards and increase aesthetic appeal, distal ends 30 of elongated members 26 may be arranged in a generally arcuate configuration, as shown in FIGS. 1 and 2. Referring to FIG. 6, each elongated member 26 includes respective distal center points 44 at the intersection of centerlines 42 of elongated members 26 with distal ends 30. Distal center points generally lie on arc 46.

Alternatively, second shelf portion 10 may have one or zero elongated members 26. One or more elongated members 26 may have distal end 30 that is not rounded. Distal end 30 of any plurality elongated members 26 may be arranged in a non-arcuate or other configuration.

As shown, respective distal end portions 30*a* of outermost elongated members 28 of elongated members 26 extend generally upward toward first shelf portion 8. However, any number or none of elongated members 26 may have distal end portions extending generally upward.

Where distal end portion 30*a* of an elongated member 26 extends generally upward, this extension, or change of direction of elongated member 26, may be said to occur at a bend line. For elongated members 26 with up turned distal end portions 30*a*, the distal center point 44 is the intersection of the elongated member's centerline 42 with the bend line. Where distal ends 30 of a plurality of elongated members 26 are arranged in an arcuate configuration, the distal center point 44 of one or more elongated members 26 having up turned distal end portion 30*a* may also lie on arc 46.

Distal end portions 30*a* may be formed by any method known in the art, such as for example, bending, molding, or any suitable method or combination of methods.

One or more upwardly extending distal end portions 30*a* may allow tool holder 2 to easily hold coiled hose 36, as shown in FIG. 5, a cord, or any other coiled object. It may also allow for the placement of a cylindrical or similar object on second shelf portion 10, to the extent that generally upwardly extending distal end portions 30*a* may keep such an object from rolling or otherwise falling off of tool holder 2 onto, for example, the floor or a mechanic's foot.

Slots defined by elongated members 26 may be used to hold a variety of objects. Such objects may include, for example, screwdrivers 22, ratchets 32, torque sticks 34, as shown in FIGS. 3, 4, and 5, hubcap hammers, or any other objects capable of being received and held within the spaces between elongated members 26. The width of elongated members 26 and the space between elongated members 26 may keep tool holder 2 residents relatively separated, allowing convenient arrangement of the residents. In the context of tools, it may make finding the desired tool quicker and easier than if the tools were, for example, piled in a tray. The design may also allow tools to be placed on and removed from holder 2 quickly and easily.

First shelf portion 8 and/or second shelf portion 10 may be used as a shelf to hold such things as, for example and as shown in FIG. 4, a magnetic tray 38 capable of holding small parts, nuts, bolts, sockets, and the like.

Figure 7:
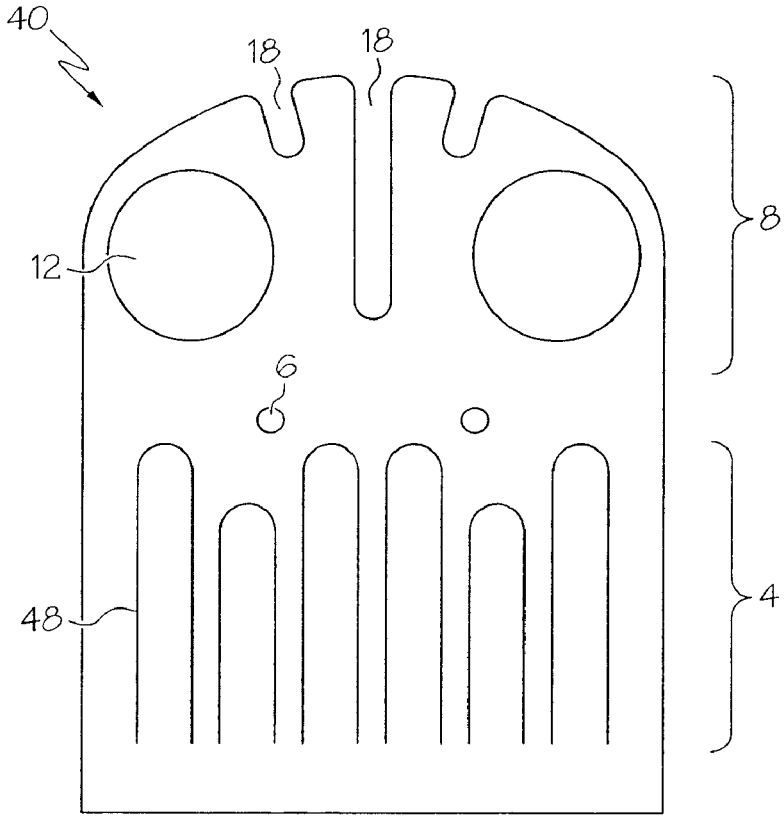
FIG. 7 is a view of the tool holder of FIG. 1 during its process of manufacture.

Tool holder 2 may be made from a single piece of metal by a simple process of, for example, stamping or cutting and bending. However, any other suitable manufacturing procedure may also be used. In the stamping and bending example, basic shape 40, as shown in FIG. 7, may be stamped from a sheet of metal. This first stamping may include the creation of the outer edge of basic shape 40 and apertures 12, and/or slots 18 in what may become first shelf portion 8. Mounting holes 6 may also be stamped. In addition, the part of basic shape 40 that may become support member 4 may be stamped or laser-cut with a plurality of "U"-shaped cuts 48, which may ultimately create elongated members 26 after bending. Any suitable method or methods may be used to create the cuts and/or openings and the like described in this paragraph.

When basic shape 40 has been cut, first shelf portion 8 and second shelf portion 10 may be created by bending. First shelf portion 8 may be created by bending the end of basic shape 40 between apertures 12 and mounting holes 6 until the end is generally perpendicular to support member 4. Second shelf portion 10 may be created by bending elongated members 26 that were created by "U"-shaped cuts 48 away from support member 4 until elongated members 26 are generally perpendicular to support member 4. If desired, distal end portions 30*a* of one or both outermost elongated members 28 or any other elongated member or members 26 may be bent generally upward. By way of example only, one or more distal end portions 30*a* may be bent such that one or more distal end portions 30*a* are generally perpendicular to outermost elongated members 28 and generally parallel to support member 4. Of course, one or more distal end portions 30*a* may be bent to any angle, such as, by way of example only, around 5 degrees, around 45 degrees, around 90 degrees, around 150 degrees, or any other angle.

It will be apparent to those of skill in the art that while a preferred embodiment of the invention has been disclosed in detail, numerous other modifications and improvements may be made thereon.

For example, distal end 30 of one or more of elongated members 26 comprising second shelf portion 10 may have an alternative means for generally retaining things between distal end 30 of elongated member 26 and support member 4. For example, distal end 30 of one or more elongated members 26 may have a dimple or similar indenture made in its bottom side, such that a small hump or knob or protuberance or similar extension exists on the top side of distal end 30. Alternatively, a protuberance or other generally upward extension may be created on the top side by any suitable method not including the creation of an indenture on the bottom side. By having a protuberance or other generally upward extension on distal end 30 of one or more of elongated members 26, or by bending one or more distal end portion 30*a*, tool holder 2 may hold tools or other objects more securely. Such distal end configuration may reduce the possibility of a held object or objects falling off of tool holder 2 onto the floor, the mechanic's foot, or any other undesirable location for a tool or other object to fall onto. Such distal end configuration may have high enough upward extension to make it necessary to lift tools or other objects over distal end 30 in order to retrieve tools or other objects from tool holder 2.

Elongated members 26 may also be bent such that the angle between the top side of elongated members 26 and the middle section of support member 4 is less than 90 degrees. This may create a tendency for tools or similar things that are held between elongated members 26 to slide toward support member 4, greatly reducing the likelihood that a resident of tool holder 2 may fall off.

Elongated members 26 may have a lip or rib added about all or part of their perimeter. Such a lip or rib or similar alteration may increase the strength of each elongated member 26, making it more difficult to bend. In addition, such a lip or rib or similar alteration may keep bolts or other relatively small objects from rolling off of an elongated member 26.

Elongated members 26 may be tapered or stepped. This may allow a broader range of tools to be held by tool holder 2. Alternatively, the widths of elongated members 26 and/or the spaces between them may be varied to allow tools of different sizes to be held.

All or part of tool holder 2 may be magnetized. This may make metal objects such as, for example, nuts and/or bolts and the like, less likely to fall off of tool holder 2.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Obvious modifications or variations are possible in light of the above teachings. The one or more embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A tool holder comprising:

a. a support member having first and second ends;

b. first and second spaced apart shelf portions extending in a first direction from said support member, wherein said first and said second shelf portions are unitary and integral with said support member;

c. said first shelf portion including at least one generally circular aperture;

d. said second shelf portion comprising a plurality of spaced apart elongated members extending from said support member.

2. The tool holder of claim 1, wherein said first shelf portion comprises a distal edge, said distal edge being generally arcuate.

3. The tool holder of claim 1, wherein said first shelf portion includes at least one slot.

4. The tool holder of claim 3, wherein said at least one slot has an open end.

5. The tool holder of claims 1, 2, 3, or 4, wherein said first shelf portion includes at least two generally circular apertures formed therethrough.

6. The tool holder of claim 1, wherein each of said elongated members comprises a respective distal end that is generally round.

7. The tool holder of claim 1, wherein the tool holder is formed of a unitary sheet of metal.

8. A tool holder comprising:

a. a support member having first and second ends;

b. first and second spaced apart shelf portions extending in a first direction from said support member, wherein said first and said second shelf portions are positioned at a fixed distance relative to one another;

c. said second shelf portion comprising a plurality of spaced apart elongated members extending from said support member, each elongated member having a respective distal end, at least one of said distal ends extending generally upward.

9. The tool holder of claim 8, wherein said plurality of spaced apart elongated members include two outermost elongated members, the respective distal end of each of said outermost elongated members extending generally upward.

10. The tool holder of claim 8, wherein the distal end of each elongated member is generally round.

11. The tool holder of claim 8, wherein the tool holder is formed of a unitary sheet of metal.

12. A tool holder comprising:

a. a support member having first and second ends;

b. first and second spaced apart shelf portions extending in a first direction from said support member, wherein said first and said second shelf portions are formed unitarily with said support member;

c. said second shelf portion comprising a plurality of spaced apart elongated members extending from said support member, each elongated member having a respective distal end, wherein a plurality of said distal ends generally lie on an arc.

13. The tool holder of claim 12, wherein each respective elongated member has a distal center point, each respective distal center point generally lying on said arc.

14. The tool holder of claim 13, wherein said arc is a circle.

15. The tool holder of claim 12, wherein said plurality of spaced apart elongated members includes first and second outermost elongated members each disposed at a respective end of said plurality, each of said first and second outermost elongated members having a respective distal end, each distal end of said first and second outermost elongated members extending generally upward.

16. The tool holder of claim 15, wherein each respective elongated member has a distal center point, each respective distal center point generally lying on said arc.

17. The tool holder of claim 12, wherein the distal end of at least one elongated member is generally round.

18. The tool holder of claim 12, wherein said first shelf portion comprises a distal edge, said distal edge being generally arcuate.

19. The tool holder of claim 12, wherein the tool holder is formed of a unitary sheet of metal.

20. A tool holder comprising:

a. a support member having first and second ends;

b. first and second spaced apart shelf portions extending in a first direction from said support member;

c. said second shelf portion comprising a plurality of spaced apart elongated members extending unitarily from said support member, each of said spaced apart elongated members being integrally formed of respective discrete portions of said support member.

21. The tool holder of claim 20, wherein each elongated member has a respective distal end, each of said respective distal ends being arranged in a generally arcuate configuration relative to each other, said arcuate configuration being generally defined by an arc.

22. The tool holder of claim 20 or 21, wherein said plurality of spaced apart elongated members include two outermost elongated members, each of said outermost elongated members extending generally upward at its respective distal end.

23. The tool holder of claim 22, wherein each respective elongated member has a distal center point, each respective distal center point generally lying on said arc.

24. The tool holder of claim 20, wherein the distal end of each elongated member is generally round.

25. The tool holder of claim 20, wherein the tool holder is formed of a unitary sheet of metal.

26. A tool holder comprising:

a. a support member having first and second ends;

b. first and second spaced apart shelf portions, extending in a first direction from said support member;

c. said second shelf portion comprising a plurality of spaced apart elongated members, wherein each elongated member has a distal end;

d. said elongated members extending from said support member creating an angle between the top side of said elongated members and said support member of less than or equal to approximately 90 degrees, wherein the tool holder is formed of a unitary sheet of metal.

27. The tool holder of claim 26, wherein at least one distal end extends generally upward generally toward said first shelf portion.

28. The tool holder of claim 26, wherein said plurality of spaced apart elongated members include two outermost elongated members, each of said outermost elongated members extending generally upward at its respective distal end.

29. The tool holder of claim 26, wherein the distal end of each elongated member is generally round.

* * * * *